United States Patent [19]

Saila

[11] 4,300,415

[45] Nov. 17, 1981

[54] ADJUSTABLE TOGGLE LOCKING CLOSED-END WRENCH

[76] Inventor: Tauno Saila, 10534 Penrose St., Sun Valley, Calif. 91352

[21] Appl. No.: 131,904

[22] Filed: Mar. 20, 1980

[51] Int. Cl.[3] ..... B25B 13/18

[52] U.S. Cl. ..... 81/128; 81/363

[58] Field of Search ..... 81/126, 128, 129, 171, 81/175, 363, 375

[56] References Cited

U.S. PATENT DOCUMENTS

| | | | |
|---|---|---|---|
| 372,080 | 10/1887 | Mitchell | 81/363 X |
| 2,391,604 | 12/1945 | Wallace | 81/363 X |
| 2,533,817 | 12/1950 | Koskinen | 81/375 |
| 2,536,463 | 1/1951 | Ratliff | 81/126 |
| 2,587,673 | 3/1952 | Aden | 81/375 |
| 3,357,285 | 12/1967 | Adair | 81/175 X |
| 3,564,956 | 2/1971 | Landen | 81/175 X |
| 4,174,646 | 11/1979 | Kotler | 81/128 |

*Primary Examiner*—James G. Smith

[57] ABSTRACT

An adjustable wrench, particularly suitable for gripping hexagonal head bolts, or hex nuts, which may be quickly adjusted to accommodate a range of bolt or nut sizes. A manually controlled, spring loaded, toggle mechanism permits the wrench to rapidly engage and disengage the bolt head during rotation about the bolt axis without having to remove the wrench from the bolt head.

9 Claims, 5 Drawing Figures

ADJUSTABLE TOGGLE LOCKING CLOSED-END WRENCH

BACKGROUND OF THE INVENTION

A variety of hand tools of the type comprising a reciprocating jaw wrench have been proposed heretofore. All have as their intended function means for gripping and holding nuts or bolts of more than a single size. These wrenches usually control the opening and closing of the jaws by means of either a traveling and rotating screw, or a cam mechanism, or a toggle linkage arrangement. The more simple of these, such as that shown and described in U.S. Pat. No. 3,625,096, comprise a stationary handle and a slidable jaw assembly having a frictional locking arrangement for maintaining a desired jaw opening. Other devices intended to accomplish a generally similar function comprise an adjustable jaw wrench which includes a toggle locking arrangement for locking the opposing jaws onto a bolt (or nut). This type of device is shown and described in U.S. Pat. Nos. 2,536,463 and 3,564,956. A similar toggle mechanism is shown in the hand tool described in U.S. Pat. No. 372,080. While each of the foregoing devices of the prior art have one or more advantageous features, they have not met with widespread economic success due to some particular shortcoming or limitation. For example, various of these prior devices are considered to be unsatisfactory because of their inability to quickly engage and thereafter quickly disengage the object to be gripped, yet be readily adjustable to accommodate a range of object sizes. It will be recognized that there may be other objections to various prior devices with respect to their ability to match the angle of the bolt faces to be gripped.

BRIEF SUMMARY OF THE INVENTION

An object of this invention is to provide a new and improved wrench which is readily adjustable with respect to the range of jaw openings, and wherein the jaws may be quickly locked and unlocked. To this end, the novel and improved wrench of the present invention comprises a sliding type of adjustable jaw which is positioned and held in place by a toggle locking mechanism, and further having a manually controlled adjustment screw for determining the main pivot position of the toggle locking lever. The toggle linkages are simplified by having the main pivot point at the location of the jawopening adjustment screw.

The geometry of the mechanism for reciprocating the slidable jaw allows for an especially compact design in which the toggle linkage can be controlled within the handle of the wrench when the jaws are closed. A spring-actuated lever permits rapid release of the slidable portion of the jaw assembly from its engaged and locked position whenever desired.

It is therefore an object of the invention to provide a novel and improved adjusting, toggle-locking, closed-end wrench having jaws capable of applying a non-slipping grip upon a polygonal object and permit the application of a rotational movement thereto.

Other objects of the invention will become apparent from the description which follows, considered in connection with the accompanying drawing.

DESCRIPTION OF THE PREFERRED EMBODIMENT

Figures 1, 2, 3, 4, 5:
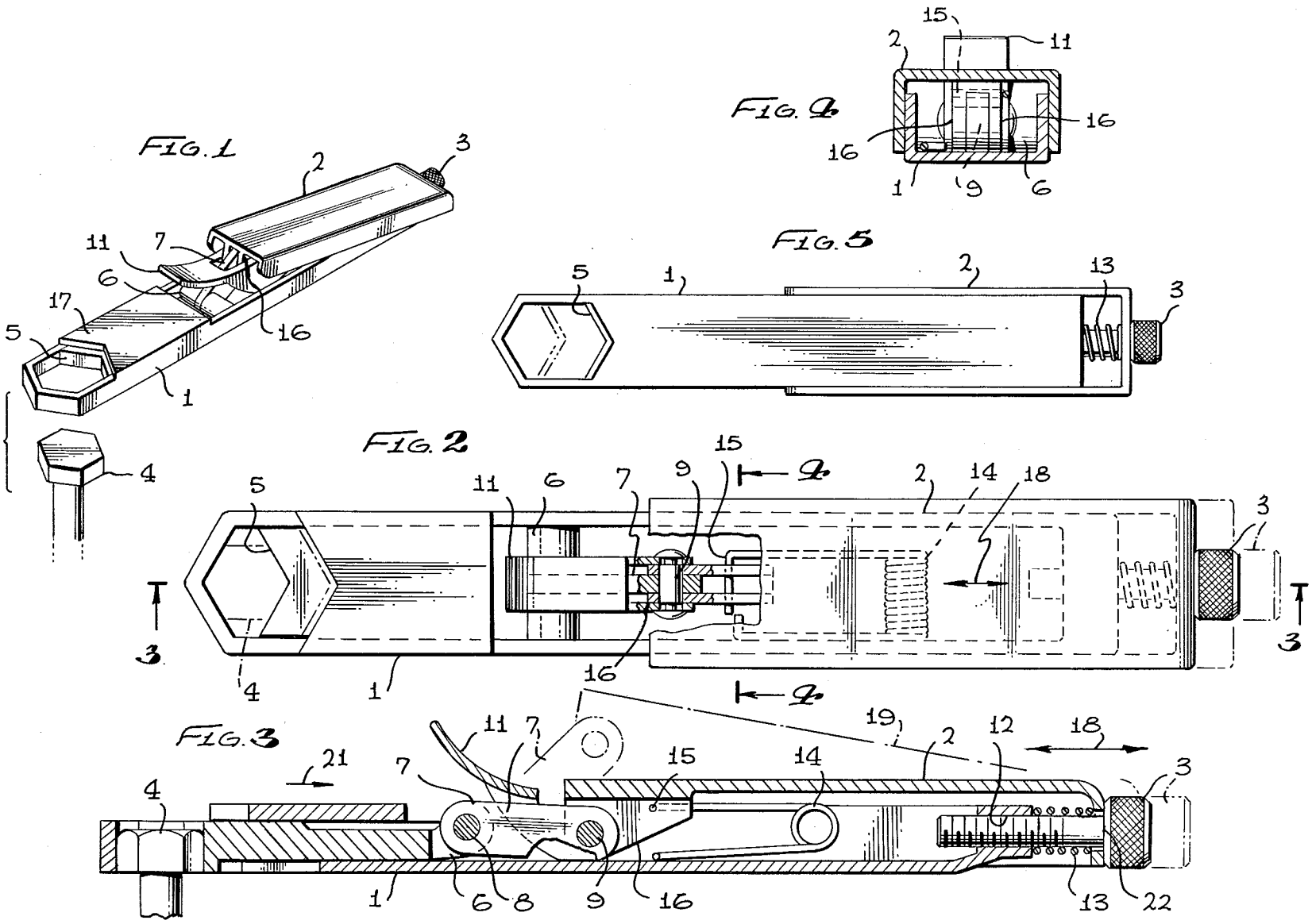
FIG. 1 is a perspective view of a preferred embodiment of the invention.
FIG. 2 is a top plan view, partially broken away, of the wrench shown in FIG. 1.
FIG. 3 is a cross-sectional, elevational view taken along line 3—3 of FIG. 2, showing the linkage mechanism.
FIG. 4 is a cross-sectional view taken along line 4—4 of FIG. 2.
FIG. 5 is a bottom plan view of the wrench shown in FIG. 1.

In FIG. 1 of the drawing there is shown a wrench constructed in accordance with the invention, and which comprises a frame 1 which serves as the lower portion of the wrench handle, and a lever handle 2, which comprises the upper portion of the wrench handle. The lever handle 2 is pivotally secured to the frame 1 by means of an adjusting screw 3 which passes through coaxially-aligned holes in both the frame 1 and the lever handle 2.

The end of the frame 1 opposite the pivot end, is formed to provide two sides of a hexagonal opening for receiving a corner of a hex nut or bolt of various sizes (such as that indicated at 4). The opposite two sides of the hexagonal opening are provided by jaw 5, which is adapted to slidably reciprocate in a channel formed within frame 1. The end of jaw 5, opposite the hexagonal opening, is provided with a pin-retained portion 6. This is in turn coupled to a link 7 via pin 8 (which can best be seen in FIG. 3). The upper end of link 7 is coupled to lever handle 2 via a pin 9 (which likewise is best seen in FIG. 3). Also coupled to link 7 and lever handle 2, via pin 9, is a release lever 11.

Frame 1 comprises a generally U-shaped channel member having an endwall portion through which passes a threaded opening 12, as shown in FIG. 3. Threaded adjusting screw 3 mates with threaded opening 12 and urges the one end of lever handle 2 into engagement with jaw-release spring 13. A handle-lift torsion spring 14 is free to slide at one end by the interior bottom wall of the frame 1, and restrained at the other (upper) end by its engagement with a receiving opening 15 in the depending web portion 16 of lever handle 2. This arrangement can also be seen in FIG. 4. Reciprocating jaw 5 is prevented from falling out of the frame by a bridge portion 17 of frame 1 which extends transversely across a portion of the upper edge of the frame channel.

As can be seen, the main pivot point of the toggle mechanism comprising the combination of jaw 5, link 7, and lever handle 2, is determined by adjusting screw 3, which selectively varies the spacing between the end of frame 1 and the confronting end of lever handle 2. This spacing is varied rectilinearly in the direction indicated by arrow 18 in FIGS. 2 and 3. It should be noted that the head of the adjusting screw 3 provides the pivot bearing surface for pivot edge 22 in the lever handle 2. The periphery of the screw head (3) may be knurled, as shown, to facilitate its being manually turned. By locating the main pivot point on the far end of the handle (viz. the end of frame 1), and on the centerline of the adjusting screw 3, the wrench may be opened very easily under the urging of lift-spring 14, and the camming action of release lever 11.

The functioning of the device may be summarized as follows: in the released or open condition, as indicated by phantom outlines (19) in FIGS. 2 and 3, the jaw 5 will be slidably, and rectilinearly, translated in the direction of arrow 21. This will cause the jaw to open. By gripping the handle portion of the wrench and squeezing frame 1 and lever handle 2 together, the force applied to link 7 will be transmitted via pin 8 to jaw 5 causing it to move in a direction tending to close the hexagonal jaw opening (as shown in solid outline in FIGS. 2 and 3). Screw 3 is appropriately adjusted so that jaw 5 will be in firm engagement with the bolt head 4 when the toggle link's common centerline snaps over the locking position in response to lever handle 2 being squeezed. In this condition, the free end of release lever 11 will be in its raised position, and the toggle-mechanism assembly will lie essentially in a single plane with respect to the major axis of the wrench handle.

When it is desired to open the "box end" of the wrench and release the jaws from the bolt 4, the release lever 11 is pushed downwardly towards the frame 1. This will cause the lowermost cam surface of the release lever (as viewed in FIG. 3) to press against the interior confronting surface of the frame channel (1) and urge the end of link 7, through which pin 9 passes, in an upwardly direction. The resulting motion of the lower end of link 7, through which pin 8 passes, will retract jaw 5.

With the lever handle 2 in the closed position, the bolt 4 can be gripped and rotated. To get another grip on the bolt to execute the next successive turn, the release lever 11 is pressed down causing spring 14 to assist in opening the jaws. Alternatively, the grip of jaw 5 on a bolt can be set so lightly (by means of adjusting screw 3) that upon releasing the squeeze on handle 2, the spring 14 will open the jaw 5 without using release lever 11. Opening of the box-end of the wrench will allow the wrench body to be rotated to a new angular position with respect to the bolt head (4). The lever handle 2 is then squeezed to re-engage the bolt head (4).

Unlike certain wrenches of the prior art, it is unnecessary for the bolt to restrain the wrench while it is being re-positioned for its next rotation. The only forces necessary to open and close the jaws are provided by the action of the wrench itself without interacting with the bolt.

The geometry of the linkange mechanism provides, in cooperation with the spring bias exerted by spring 13, an effective "snap action" toggling from a stable-closed position to a stable-open position, and conversely.

The mean effective opening of the box end of the wrench is determined by adjusting screw 3.

In a preferred construction of the invention, the lever handle 2 is formed in the shape of a U-channel of a width great enough to permit it to straddle the U-shaped channel comprising the frame 1 (as best seen in FIG. 4). This configuration results in a sturdy yet comfortable hand grip for the wrench, while making the overall size more compact than conventional designs.

The hexagonal geometry of the jaw opening closes snugly on the corners of the bolt head (or nut) to prevent slipping. Essentially all of the applied forces in the mechanism are in either compression or tension (viz., recilinear) with minimum torsion, bending, or deflection. This results in an absence of slipping and permits a more compact tool to be made.

From the foregoing description and drawing it will be seen that the objectives of the invention have been achieved. It will be recognized by those skilled in the art that certain modifications may be made within the foregoing teaching of the invention. For example, the box end of the wrench may be varied from the hexagonal configuration shown while retaining all of the benefits of the remaining portion of the device. It is therefore the intent that the scope of the protection afforded hereby be limited only by the appended claims.

What is claimed is:

1. A wrench comprising:

an elongated frame comprising a first end having a fixed jaw portion and a second end having a threaded screw-receiving opening;

lever handle means having a link receiving aperture in a first end thereof and a screw-receiving aperture in a second end thereof;

a threaded adjusting screw extending through said screw-receiving aperture of said lever handle means and mating with said screw-receiving opening so as to pivotally mount said second end of said lever handle means to said second end of said frame;

a rectilinearly movable jaw member slidably mounted within said frame and disposed in opposition to said fixed jaw portion;

an elongated link member having first and second ends;

first connecting means pivotally coupling the first end of said link member to said link receiving aperture in said lever handle means;

second connecting means pivotally coupling the second end of said link member to said movable jaw member; and means coupled to said link member for imparting an arcuate motion to one end thereof and thereby impart a translational movement to said movable jaw mamber.

2. A wrench as defined in claim 1 wherein said frame comprises:

a U-shaped channel member disposed intermediate said ends thereof.

3. A wrench as defined in claim 1 wherein said fixed jaw portion has four contiguous interior faces joining at obtuse angles so as to complement the shape of a hexangonal object to be gripped by said wrench.

4. A wrench as defined in claim 3 wherein said movable jaw member has two contiguous interior faces joining at obtuse angles so as to have complementary symmetry with respect to a pair of confronting faces of said hexagonal object.

5. A wrench as defined in claim 1 including a compression spring interposed between the second end of said frame and the second end of said lever handle means for biasing said second ends apart.

6. A wrench as defined in claim 1 wherein said lever handle means comprises:

a U-shaped channel member between said ends thereof.

7. A wrench as defined in claim 1 wherein said first and second connecting means comprise first and second pins, respectively.

8. A wrench as defined in claim 1 including a torsion spring means disposed between said frame and said first end of said lever handle means whereby said torsion spring means tends to urge said first end of said lever handle means away from said frame.

9. A wrench as defined in claim 1 wherein said arcuate motion imparting means coupled to said link member comprises:

a pivotally mounted release lever having a cam surface in opposition to an interior surface of said frame.

* * * * *